US006281793B1

(12) United States Patent
Haimovich et al.

(10) Patent No.: US 6,281,793 B1
(45) Date of Patent: Aug. 28, 2001

(54) ELECTRONIC MONITORING APPARATUS

(75) Inventors: Yosef Haimovich, Rishon le Zion; Yehuda Armoni, Reut; Michael Auerbach, Maccabim, all of (IL)

(73) Assignee: Hi-G-Tek Ltd., Or-Yehuda (IL)

( * ) Notice: Subject to any disclaimer, the term of this patent is extended or adjusted under 35 U.S.C. 154(b) by 0 days.

(21) Appl. No.: 09/385,340

(22) Filed: Aug. 30, 1999

(30) Foreign Application Priority Data

Aug. 31, 1998 (IL) ..... 126008

(51) Int. Cl.[7] ..... G08B 13/08
(52) U.S. Cl. ..... 340/545.1; 340/542; 340/545.6
(58) Field of Search ..... 340/545.1, 542, 340/545.6, 687

(56) References Cited

U.S. PATENT DOCUMENTS 3,714,644 * 1/1973 Hellstrom ..... 340/542 X
4,233,595 * 11/1980 Landkammer ..... 340/542
4,748,668 5/1988 Shamir et al. ..... 380/30
4,766,419 8/1988 Hayward ..... 340/545
5,097,253 * 3/1992 Eschbach et al. ..... 340/545.1
5,191,314 * 3/1993 Ackerman et al. ..... 340/542
5,422,627 * 6/1995 Tap et al. ..... 340/542
5,447,344 9/1995 Hayward ..... 292/246
5,515,030 * 5/1996 Citron et al. ..... 340/545.6 X
5,656,996 * 8/1997 Houser ..... 340/541
5,754,108 * 5/1998 Ungarsohn ..... 340/568.1
6,002,343 * 12/1999 Auerbach et al. ..... 340/10.41

* cited by examiner

*Primary Examiner*—Thomas Mullen
(74) *Attorney, Agent, or Firm*—Abelman, Frayne & Schwab

(57) ABSTRACT

Electronic monitoring apparatus including an object to be protected, an electronic seal body integrally formed with the object to be protected, an electronic seal wire attachable to the seal body, the seal wire having an electrical signature which is not readable without disengagement of the seal wire from the seal body, and electronic seal circuitry in electrical communication with the seal wire which senses a change in the electrical signature.

5 Claims, 3 Drawing Sheets

ELECTRONIC MONITORING APPARATUS

FIELD OF THE INVENTION

The present invention relates electronic seals generally, and particularly to RF-interrogated identification tags and electronic seals.

BACKGROUND OF THE INVENTION

Electronic tags are known that can be monitored, sensed, or interrogated for purposes of preventing theft of or tampering with the object. For example, applicant/assignee's U.S. patent application Ser. No. 08/815,389, now U.S. Pat. No. 6,002,343, the disclosure of which is incorporated herein by reference, describes a battery-operated electronic tag that, when tampered with, communicates via a transceiver to a detection system for providing an alarm signal or other indication. One embodiment disclosed in 08/815,389 is directed to a tag with a seal wire which comprises a multiplicity of resistive wires, preferably constructed of a high resistivity material such as nickel chrome. Each wire is insulated from each other and from the external world. A random number of wires are electrically connected to electrical pins of the tag. The random connection results in a statistically random electrical resistance of the seal wire, which resistance cannot be measured from the outside of the tag. This electronic tag has already enjoyed commercial success and is marketed under the trade name HI-G-SEAL.

U.S. Pat. No. 4,766,419 to Hayward describes a reusable seal for a vehicle or container which includes a housing, and a cable secured at one end to the housing and releasably attached to the housing at the other end by a locking mechanism. Operation of the locking mechanism causes an electronic circuit in the housing to generate a random number, which is displayed by an LED display when a button is pressed. Any change in the number displayed indicates that the cable has been released. The seal can be repeatedly re-used.

U.S. Pat. No. 5,447,344, also to Hayward, describes an electronic seal including a housing, a flexible element extending from the housing and having a free end which can be passed through a door catch device for releasably connecting the free end of the flexible element to the housing, an electronic circuit within the housing arranged to generate one of a number of unique codes on receipt of an electrical signal and to store the generated code, display device on the housing adapted to display the generated code, and a switch on the housing actuated on connection or disconnection of the flexible element to the housing to provide an electrical signal to actuate the electronic circuit. The flexible element is a cord having a series of regularly spaced enlargements, and the device for releasably connecting the free end of the cord to the housing comprises a passage in the housing into which a length of the cord can be inserted, a number of teeth in the housing being adapted to fit between enlargements of the cord, so that when the length of cord is inserted into the housing each enlargement of the length of cord can fit between two adjacent teeth to hold the cord against withdrawal from the housing, and a slide movable in the housing between a first position in which the cord can be inserted and removed from the passage, and a second position in which the slide retains the enlargements in engagement with the teeth. The switch has an actuating member projecting between two of the teeth, so as to be engaged by one of the enlargements on the cord when it is engaged between the teeth, so that the switch is actuated when the length of cord is moved into or out of engagement with the teeth.

It is noted that in both patents of Hayward there is no sealing wire with a signature. Instead the electrical circuitry in the seal housing generates a random signature.

SUMMARY OF THE INVENTION

The present invention seeks to provide a novel electronic seal, based on the technology of the seal wire described in 08/815,389, wherein the electronic seal is integrated with the object to be protected. The body of the electronic seal is integrally formed with the object to be protected, or may be embedded, bonded, fastened or otherwise attached to the object to be protected. The seal wire has a signature which is not readable without disengaging the seal wire from the seal body, and any such disengaging is sensed by the electronic seal circuitry.

There is thus provided in accordance with a preferred embodiment of the present invention electronic monitoring apparatus including an object to be protected, an electronic seal body integrally formed with the object to be protected, an electronic seal wire attachable to the seal body, the seal wire having an electrical signature which is not readable without disengagement of the seal wire from the seal body, and electronic seal circuitry in electrical communication with the seal wire which senses a change in the electrical signature.

There is also provided in accordance with a preferred embodiment of the present invention electronic monitoring apparatus including an object to be protected, an electronic seal body including two halves, each half attached to the object to be protected, an electronic seal wire having two ends each of which is attachable to one of the halves of the seal body, the seal wire having an electrical signature which is not readable without disengagement of the seal wire from the seal body, and electronic seal circuitry in electrical communication with the seal wire which senses a change in the electrical signature.

In accordance with a preferred embodiment of the present invention the object includes a door and an enclosure, and wherein one of the halves is attached to the door and the other half is attached to a portion of the enclosure, wherein the door is openable only under two conditions: a) tampering with the seal wire, b) disengagement of the seal wire from the seal body.

Further in accordance with a preferred embodiment of the present invention the halves are in electrical communication with each other.

Still further in accordance with a preferred embodiment of the present invention the halves are in electrical communication with each other via the seal wire.

There is also provided in accordance with a preferred embodiment of the present invention a method for protecting an object including integrally forming an electronic seal body with an object to be protected, providing an electronic seal wire separately from the seal body, attaching the electronic seal wire to the seal body, the seal wire having an electrical signature which is not readable without disengagement of the seal wire from the seal body, and sensing a change in the electrical signature.

In accordance with a preferred embodiment of the present invention the electronic seal body is formed with the object by a manufacturer of the object and the electronic seal wire is provided to a user of the object.

Further in accordance with a preferred embodiment of the present invention the method includes communicating with at least one of the electronic seal body and the electronic seal wire by means of encrypted communication.

Still further in accordance with a preferred embodiment of the present invention the encrypted communication includes a mutual zero-knowledge interaction authentication session.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
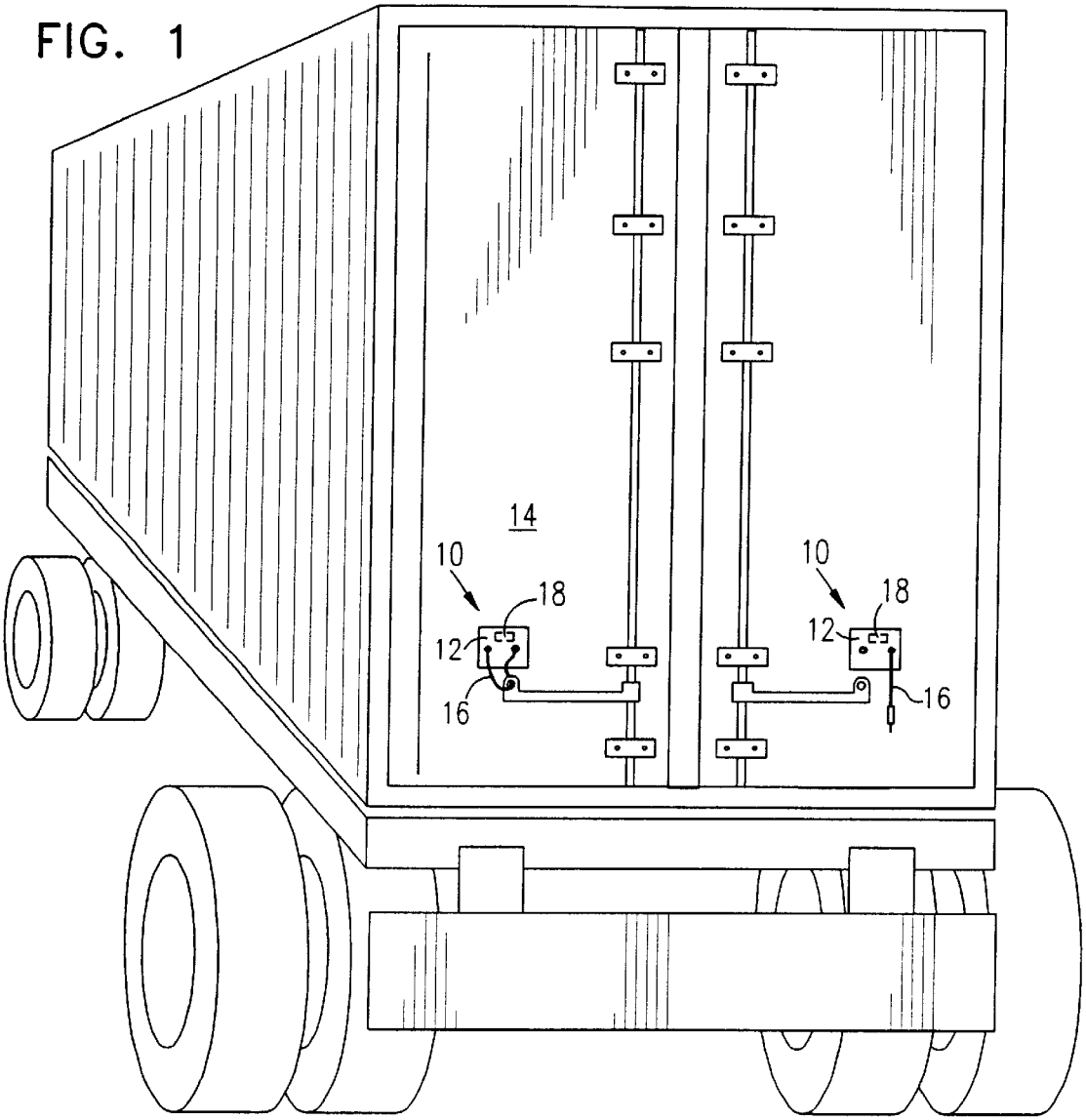
FIG. 1 is a simplified pictorial illustration of electronic monitoring apparatus constructed and operative in accordance with a preferred embodiment of the present invention.

Reference is now made to FIG. 1 which illustrates electronic monitoring apparatus 10 constructed and operative in accordance with a preferred embodiment of the present invention.

Apparatus 10 preferably includes an electronic seal body 12 integrally formed with an object 14 to be protected. In the illustrated embodiment, the object 14 is a semi-trailer, and seal body 12 is integrally formed with the back door of the trailer. Alternatively, seal body 12 may be embedded, bonded, fastened or otherwise attached to object 14.

An electronic seal wire 16 is attachable to seal body 12. Seal wire 16 has an electrical signature which cannot be read or detected from outside the seal without disengagement of seal wire 16 from seal body 12, in accordance with the teachings of U.S. patent application Ser. No. 08/815,389. As disclosed in 08/815,389, electronic seal circuitry 18 is provided which is in electrical communication with seal wire 16 and senses a change in the electrical signature of seal wire 16. Thus if any attempt is made to tamper with apparatus 10, electronic seal circuitry 18 alerts of such an attempt.

It is appreciated that electronic seal circuitry 18 may be housed in apparatus 10 or may be remotely located from apparatus 10 and in communication therewith. Communication with apparatus 10, including communication of any changes in the electrical signature of seal wire 16 to an alarm system, may be accomplished by any kind of suitable communication. In order to enhance security, communication with apparatus 10 may be encrypted. For example, well known encryption algorithms, such as RC-5, DES or DVB, may be employed. To provide an even greater level of trust, mutual zero-knowledge interaction authentication sessions between a monitoring station (not shown) and apparatus 10 may be held, such as the so-called Fiat-Shamir authentication methods taught in U.S. Pat. No. 4,748,668 to Shamir and Fiat, the disclosure of which is incorporated herein by reference.

An advantage of the present invention over the prior art is that seal body 12 may be attached to object 14 by the manufacturer, and seal wire 16 may be provided separately to authorized personnel.

Figure 2:
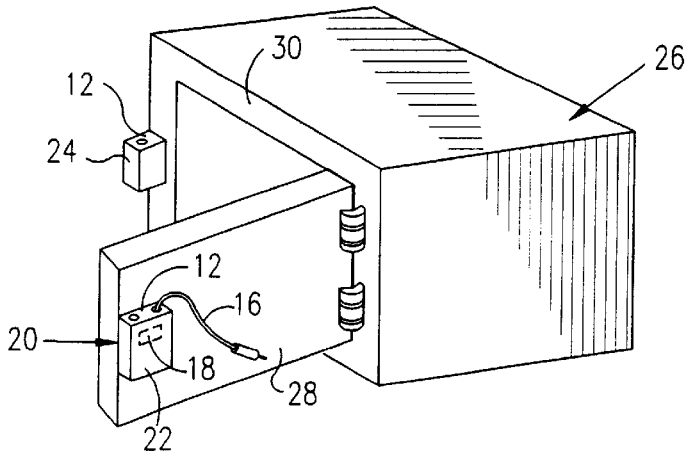
FIGS. 2, 3 and 4 are simplified pictorial illustrations of electronic monitoring apparatus constructed and operative in accordance with three preferred embodiments of the present invention, wherein the electronic monitoring apparatus includes an electronic seal body with two halves.
Figure 3:
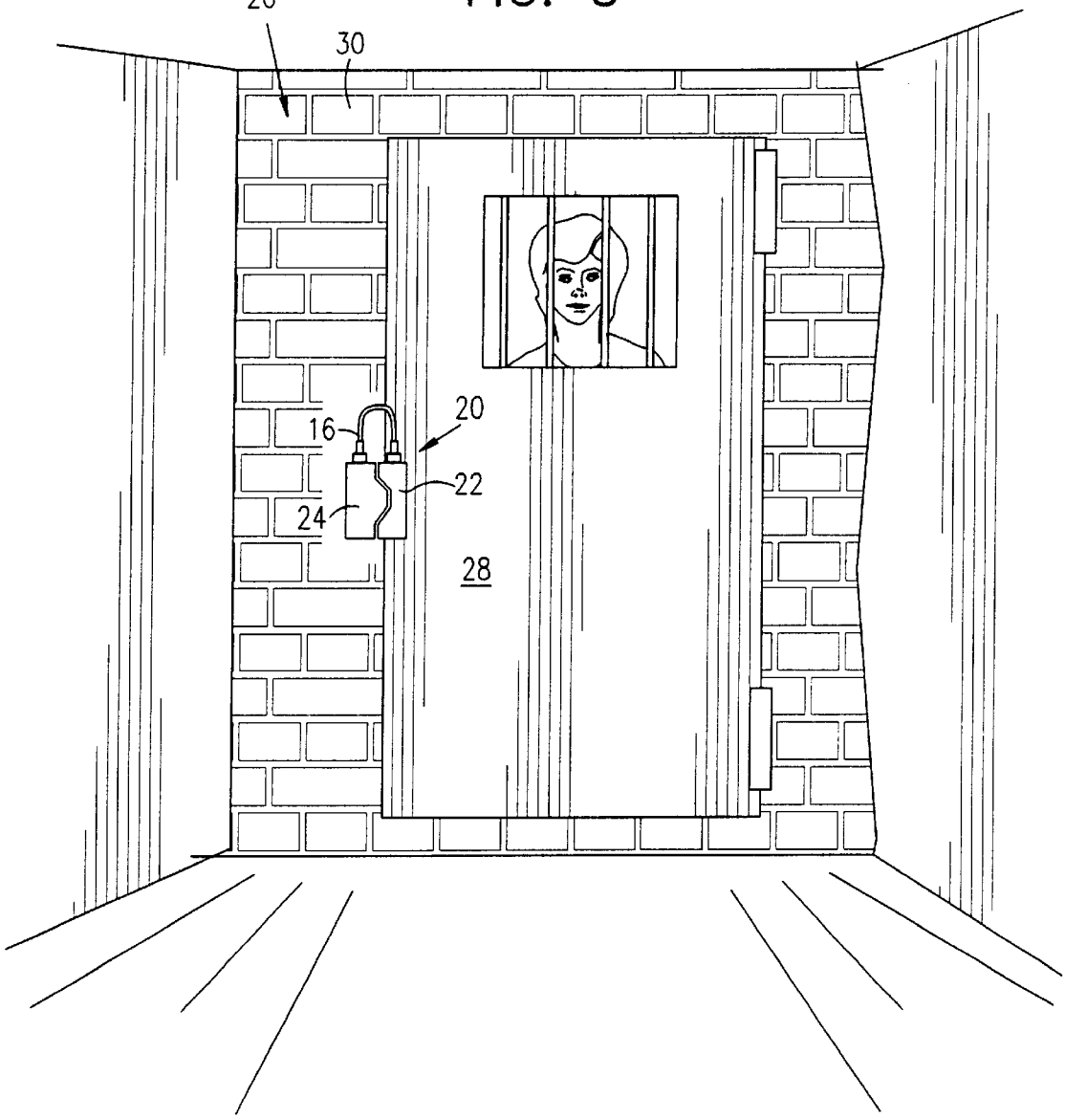
Figure 4:
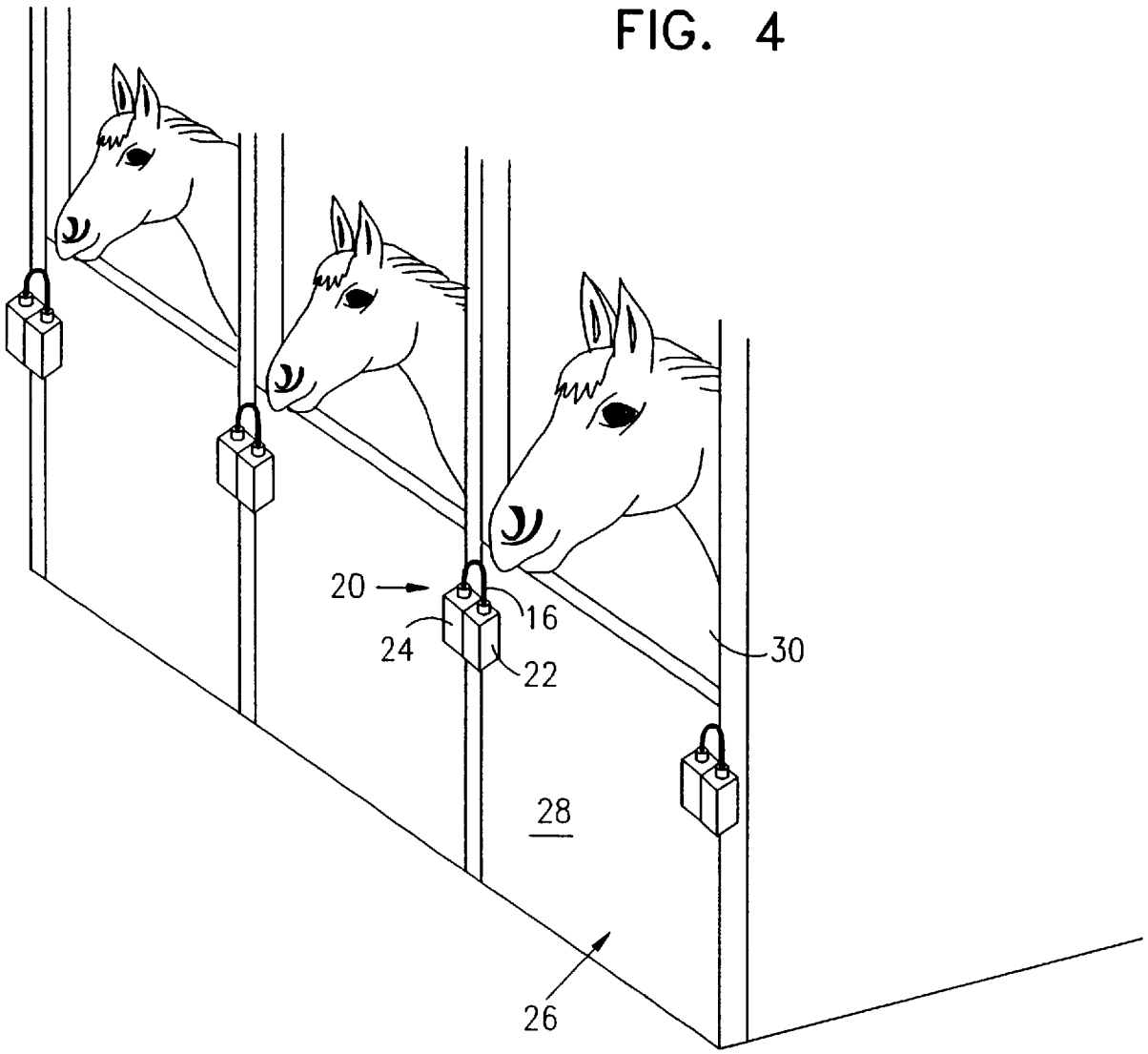

Reference is now made to FIGS. 2–4 which illustrate electronic monitoring apparatus 20 constructed and operative in accordance with a preferred embodiment of the present invention. Electronic monitoring apparatus 20 is similar in construction to electronic monitoring apparatus 10 with like numerals designating like elements. Electronic monitoring apparatus 20 differs from electronic monitoring apparatus 10 in that electronic monitoring apparatus 20 includes two halves 22 and 24, each half attached to an object 26 to be protected. In the illustrated embodiments, object 26 (in FIG. 2, a safe, in FIG. 3, a prison cell, in FIG. 4, a stable) includes a door 28 and an enclosure 30. Half 22 is attached to door 28 and the other half 24 is attached to a portion of enclosure 30. It is seen that door 28 is openable only by tampering with seal wire 16, or by disengaging seal wire 16 from seal body 12.

Half 22 is preferably in electrical communication with half 24 such as by means of seal wire 16 itself or alternatively an auxiliary wire.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. Electronic monitoring apparatus comprising:

an object to be protected;

an electronic seal body integrally formed with said object to be protected;

an electronic seal wire attachable to said seal body, said seal wire having an electrical signature which is not readable without disengagement of the seal wire from the seal body; and electronic seal circuitry in electrical communication with said seal wire which senses a change in said electrical signature resulting from disengagement of said seal wire from said seal body.

2. A method for protecting an object comprising:

integrally forming an electronic seal body with an object to be protected;

providing an electronic seal wire separately from said seal body;

attaching said electronic seal wire to said seal body, said seal wire having an electrical signature which is not readable without disengagement or the seal wire from the seal body; and sensing a change in said electrical signature resulting from disengagement of said seal wire from said seal body.

3. The method according to claim 2 wherein said electronic seal body is formed with the object by a manufacturer of the object and said electronic seal wire is provided to a user of the object.

4. The method according to claim 2 and further comprising communicating with at least one of said electronic seal body and said electronic seal wire by means of encrypted communication.

5. The method according to claim 4 wherein said encrypted communication comprises a mutual zero-knowledge interaction authentication session.

* * * * *